US006520893B2

(12) United States Patent
Bray

(10) Patent No.: US 6,520,893 B2
(45) Date of Patent: Feb. 18, 2003

(54) METHOD OF USING AN INFLATABLE EXERCISE BELT

(76) Inventor: Craig A. Bray, 1811½ Citrus Ave., Redlands, CA (US) 92374

( * ) Notice: Subject to any disclaimer, the term of this patent is extended or adjusted under 35 U.S.C. 154(b) by 0 days.

(21) Appl. No.: 09/912,185

(22) Filed: Jul. 24, 2001

(65) Prior Publication Data

US 2002/0010060 A1 Jan. 24, 2002

Related U.S. Application Data

(60) Provisional application No. 60/220,402, filed on Jul. 24, 2000.

(51) Int. Cl.[7] ..... A63B 26/00; A63B 71/00

(52) U.S. Cl. ..... 482/140; 482/55; 482/111; 602/13

(58) Field of Search ..... 485/105; 482/105, 482/140, 111, 55, 51; 441/94, 106, 108, 113–114, 119; 9/340–346, 316–319, 311–312, 329, 337; 602/13, 19; 128/876

(56) References Cited

U.S. PATENT DOCUMENTS

| | | | | |
|---|---|---|---|---|
| 4,360,351 | A | 11/1982 | Travinski | 441/94 |
| 4,824,105 | A | 4/1989 | Goldenberg | 272/130 |
| D302,874 | S | 8/1989 | Bossart | D29/6 |
| 5,348,504 | A | 9/1994 | Pierce et al. | 441/113 |
| 5,382,184 | A | 1/1995 | DiForte | 441/108 |
| 5,437,615 | A | 8/1995 | Pekar et al. | 602/19 |
| 5,450,585 | A | 9/1995 | Zablotsky et al. | 128/76 |
| 5,628,721 | A | 5/1997 | Arnold et al. | 602/19 |
| 5,638,550 | A | 6/1997 | Hube | 2/311 |
| 5,820,530 | A | 10/1998 | Kallassy | 482/111 |

*Primary Examiner*—Jerome W. Donnelly
*Assistant Examiner*—Lori Baker Amerson
(74) *Attorney, Agent, or Firm*—Timothy Thut Tyson; Ted Masters Freilich Hornbaker & Rosen

(57) ABSTRACT

An inflatable exercise belt (20) for placement around the abdomen of a user includes a substantially belt-shaped body (22) having a first end portion (24) and an opposite second end portion (26). A selectively inflatable air chamber (32) is disposed at first end portion (24). Backing (36) is disposed adjacent to the inflatable air chamber (32), so that when the inflatable air chamber (32) is inflated, the inflatable air chamber (32) expands in a direction away from backing (36) thereby exerting pressure on the abdomen of the user.

1 Claim, 3 Drawing Sheets

20
24
28
22
40
26

20
24
38
34
35
22
30
26

36
20
32
38
34
35
22
30
28
40
26

METHOD OF USING AN INFLATABLE EXERCISE BELT

CROSS REFERENCE TO RELATED APPLICATION

This application claims the filing benefit under 35 U.S.C. §119(e) of U.S. Provisional Application No. 60/220,402, filed Jul. 24, 2000 which is included herein by reference.

TECHNICAL FIELD

The present invention pertains generally to physical fitness, and in particular to an exercise belt having an inflatable air chamber or bladder which is positioned against the abdomen of a user to promote flattening and firming of the abdominal muscles.

BACKGROUND ART

Exercise belts are well known in the art. These belts are typically designed to fit around the waist of a user, and are utilized when the user is exercising or engaged in other activities to flatten and firm abdominal muscles. The abdominal muscles are stimulated by having points of applied external pressure. For example, when an object is slowly pushed into the stomach muscles, the muscles automatically resist the pressure by tightening. The purpose for stimulating the stomach muscles is to exercise the muscles efficiently. This tones the muscles. The exercise belt is optimally used in conjunction with regular exercise to enhance the results of the exercise.

Alternatively, exercise belts can be utilized to provide bracing and support for the back of the user, particularly user's who are afflicted with back problems. For example, U.S. Pat. No. 5,628,721 illustrates a back support assembly having an inflatable air cushion. The back support assembly includes a bulb pump which when pumped or squeezed by the user inflates an air cushion to exert the desired pressure and fit against the user's lower back. The cushion is secured to the middle of the elastic belt, which is adapted to wrap around the user's back to position the air cushion against the middle of the user's back.

DISCLOSURE OF INVENTION

The present invention is directed to an inflatable exercise belt which can be worn during exercise such as aerobics or sports activities, or during other activities such as running or walking. The exercise belt flattens and firms the abdominal muscles, and also helps with posture by giving support to the lower back. An inflatable air chamber or bladder places isometric pressure against the abdominal muscles. This causes the abdominal muscles to flex, and react. The pressure also causes the back muscles to react, causing the wearer to stand straighter with better posture. Additionally, the belt holds firmly against the back, giving the user even more support.

A unique feature of the invention is the air chamber. When inflated the air chamber comprises a single rubber cylinder that is up to 4 inches in diameter and 10 inches long. The air chamber is placed along the lower abdominal region of the wearer. Since abdominal muscles run horizontally, when the belt is worn, the air chamber is oriented horizontally along all the muscles to promote greater stimulation. The inflated air chamber serves to tone and firm both the abdominal and back muscles. A small built in bulb-type pump and control valve allow for very precise adjustment of the pressure against the abdomen and the tightness around the waist. In a preferred embodiment, the belt of the present invention is constructed of neoprene, "rip stop" nylon, and vinyl. An advantage of neoprene is that during exercise it induces the user to sweat and thereby lose weight. The present invention is designed and constructed in two embodiments, one for men, and the other for women. In the embodiment for men, the inflatable exercise belt is substantially straight, and the belt is place above the naval. In the embodiment for women, the belt is curved thereby allowing the belt to be placed around the lower abdomen and hips.

In accordance with a preferred embodiment of the invention, an inflatable exercise belt, includes a substantially belt-shaped body having a first end portion and an opposite second end portion. A selectively inflatable air chamber is disposed at the first end portion. By having the inflatable air chamber at one end of the belt, a user may attach the belt in the front, thereby avoiding the awkward need to make the connection behind his/her back. A backing is positioned next to the inflatable air chamber, so that when the chamber is inflated the pressure from the air chamber is exerted inwardly against the user, rather than simply ballooning outwardly.

In accordance with an important aspect of the invention, when inflated the air chamber has a diameter of between about 0.5 inches and 4 inches and a length of about 10 inches.

In accordance with an important feature of the invention, a bulb-type pump communicates with the inflatable air chamber for selectively inflating same.

In accordance with another feature of the invention, the exercise belt has hook and loop fasteners for attaching the belt around a user.

In accordance with another preferred embodiment of the invention, the exercise belt is curved to better accommodate the abdomen of a female user.

In accordance with a preferred feature of the invention, the various layers of the inflatable exercise belt are sewn together.

Other features and advantages of the present invention will become apparent from the following detailed description, taken in conjunction with the accompanying drawings, which illustrate, by way of example, the principles of the invention.

MODES FOR CARRYING OUT THE INVENTION

Figures 1, 2, 3:
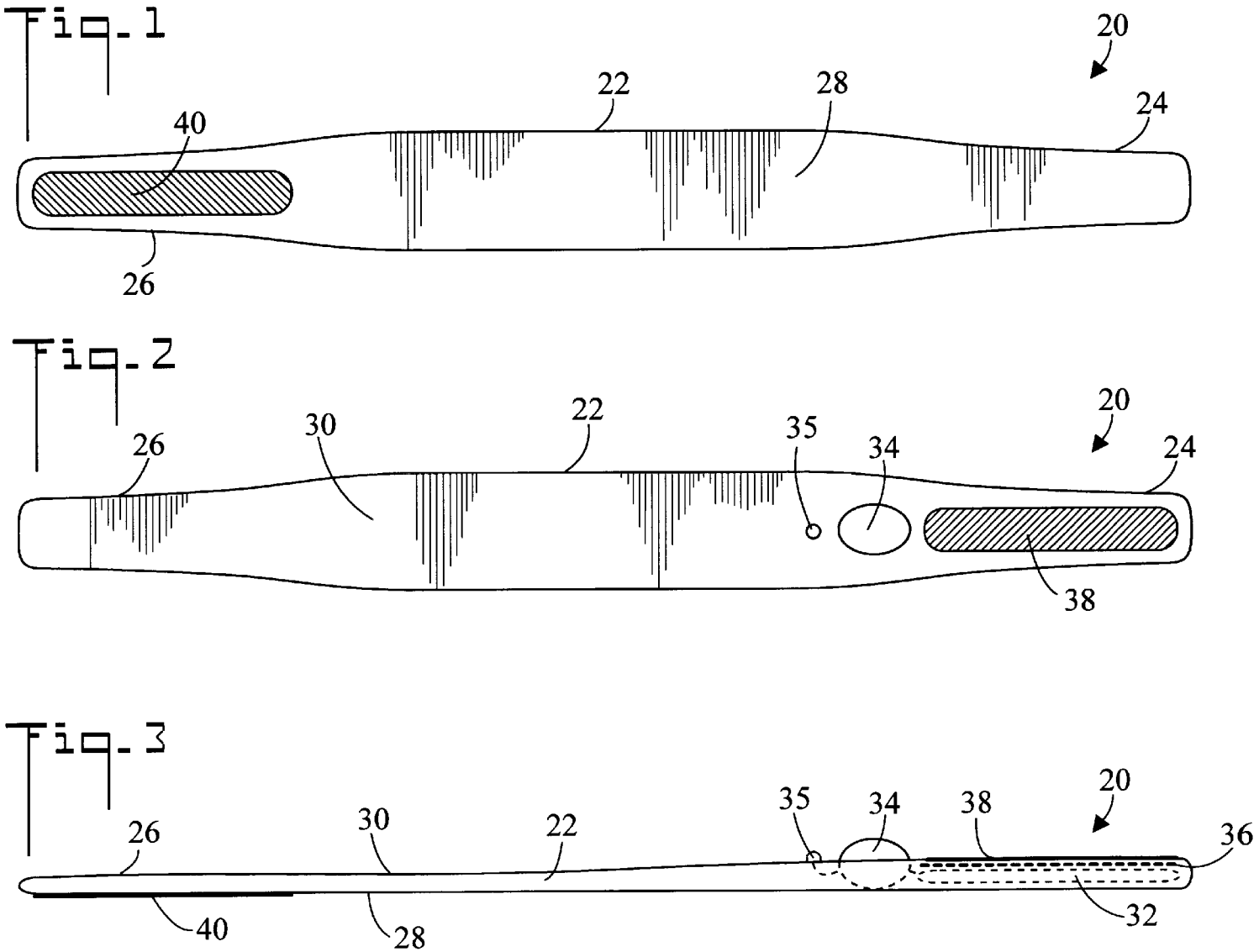
FIG. 1 is an inside plan view of an inflatable exercise belt in accordance with the present invention.
FIG. 2 is an outside plan view of the inflatable exercise belt.
FIG. 3 is a side elevation view of the inflatable exercise belt.

Referring initially to FIGS. 1–3, there are illustrated inside plan, outside plan, and side elevation views respectively of an inflatable exercise belt in accordance with the present invention, generally designated as 20. Inflatable exercise belt 20 includes a substantially belt-shaped body 22 having a first end portion 24 and an opposite second end portion 26. Belt-shaped body 22 has a first side 28 or inside, which when exercise belt 20 is worn by a user, is placed against the body of the user, and an opposite second side 30 or outside. An inflatable air chamber 32 is disposed at first end portion 24. In a preferred embodiment inflatable air chamber 32 is fabricated from rubber, and a bulb-type pump 34 communicates with inflatable air chamber 32 for selectively inflating same. A control valve 35 allows air from pump 34 to inflate air chamber 32, or alternatively allows air to be emptied from inflatable air chamber 32. When inflatable air chamber 32 is inflated, it has a substantially cylindrical shape having a diameter of between about 0.5 inches and 4 inches and a length of about 10 inches (refer to FIG. 4). Backing 36 (also refer to FIG. 6) is disposed adjacent to inflatable air chamber 32, so that when inflatable air chamber 32 is inflated, it expands in a direction away from backing 36 and toward inside 28. One 38 of hook and loop fasteners is disposed at first end portion 24 on second side 30, and the other 40 of hook and loop fasteners is disposed at second end portion 26 on first side 28.

Figure 4:
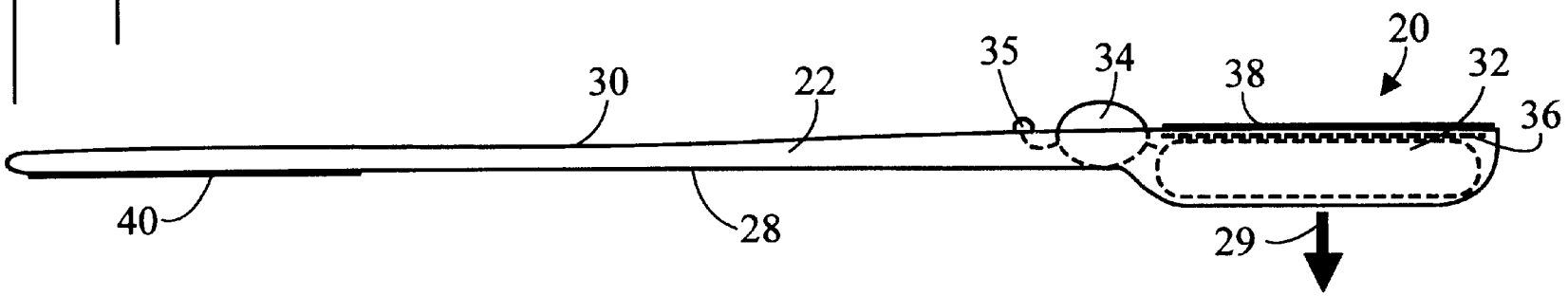
FIG. 4 is a side elevation view of the inflatable exercise belt with an inflatable air chamber inflated.

FIG. 4 is a side elevation view of inflatable exercise belt 20 with inflatable air chamber 32 inflated. Backing 36 causes inflatable air chamber 32 to expand in direction 29 which is to the inside 28 of the exercise belt 20, thereby exerting pressure directly on the user. Absent backing 36, inflatable air chamber 32 would balloon outwardly toward outside 30.

Figure 5:
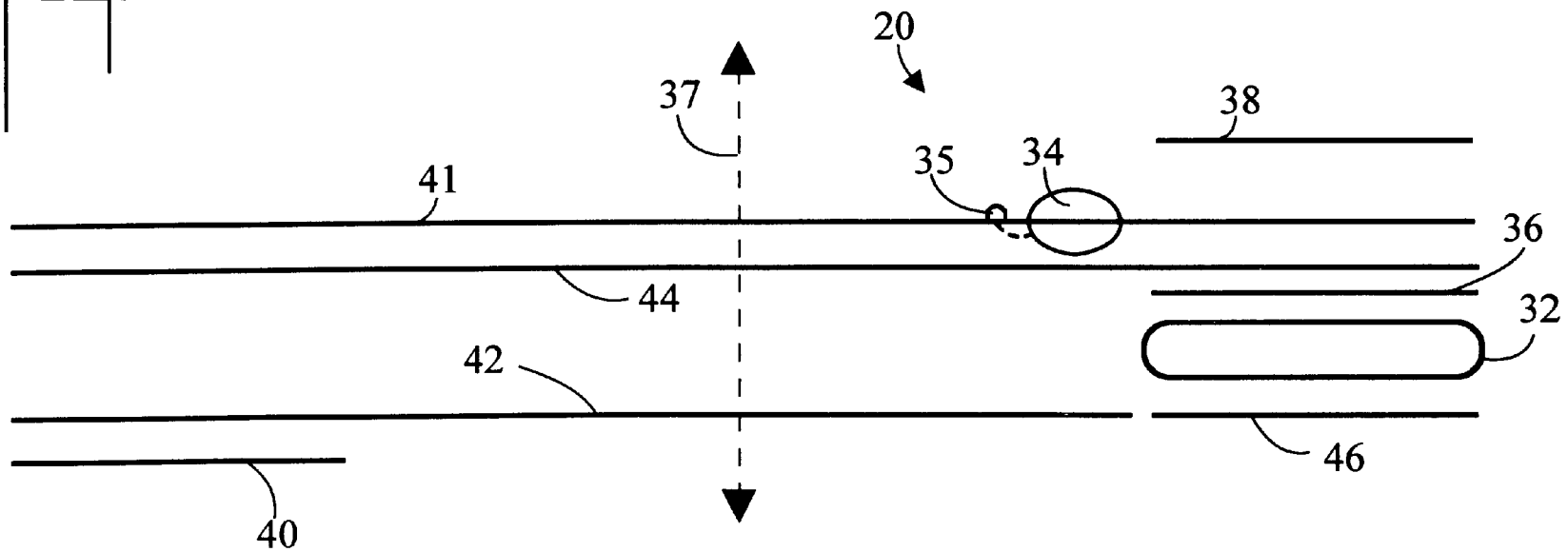
FIG. 5 is a simplified exploded cross sectional view of FIG. 3 showing the various layers of the inflatable exercise belt.

FIG. 5 is a simplified exploded cross sectional view of FIG. 3 along line 37 showing the various layers of the inflatable exercise belt 20. Inflatable exercise belt 20 is fabricated from layers of rip stop nylon 41, neoprene 42, vinyl 44, and lycra 46. An important feature of the invention is a backing 36, such as plastic, adjacent to inflatable air chamber 32, so that when it is inflated, air chamber 32 exerts pressure on the user rather than ballooning outwardly.

Figure 6:
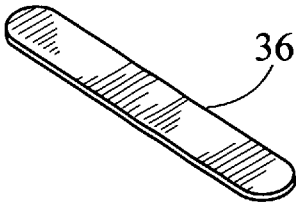
FIG. 6 is a perspective view of backing.

FIG. 6 is a perspective view of backing 36. In a preferred embodiment, backing 36 is fabricated from a firm substantially flat piece of plastic.

Figure 7:
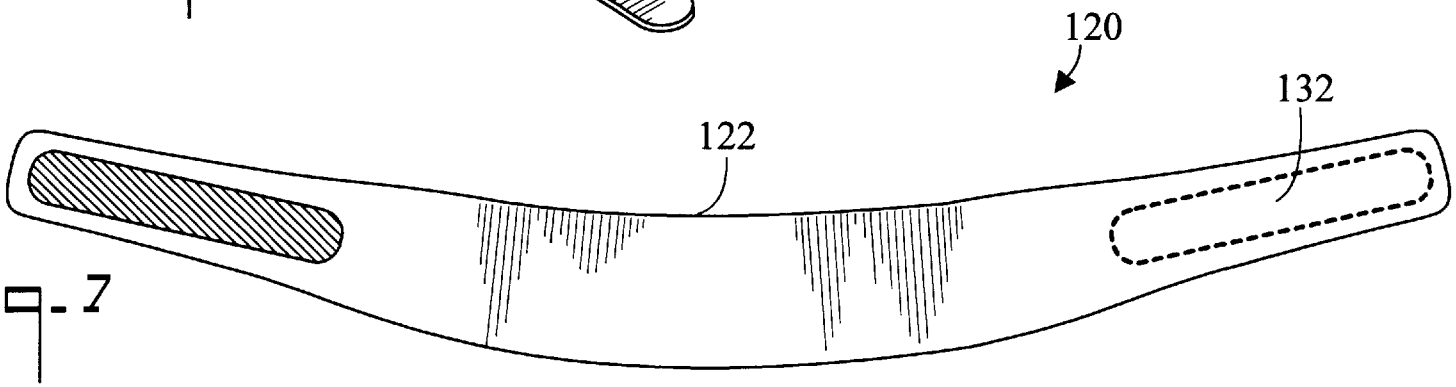
FIG. 7 is an inside plan view of a second embodiment of the exercise belt specifically designed for women; and, FIG. 8 is a side elevation view of a wearer using the present invention.

FIG. 7 is an inside plan view of a second embodiment of the exercise belt specifically designed for women, generally designated as 120. Exercise belt 120 has a belt-shaped body 122 which is curved, thereby permitting belt 120 to be positioned around the lower abdomen and hips of a female user.

Figure 8:
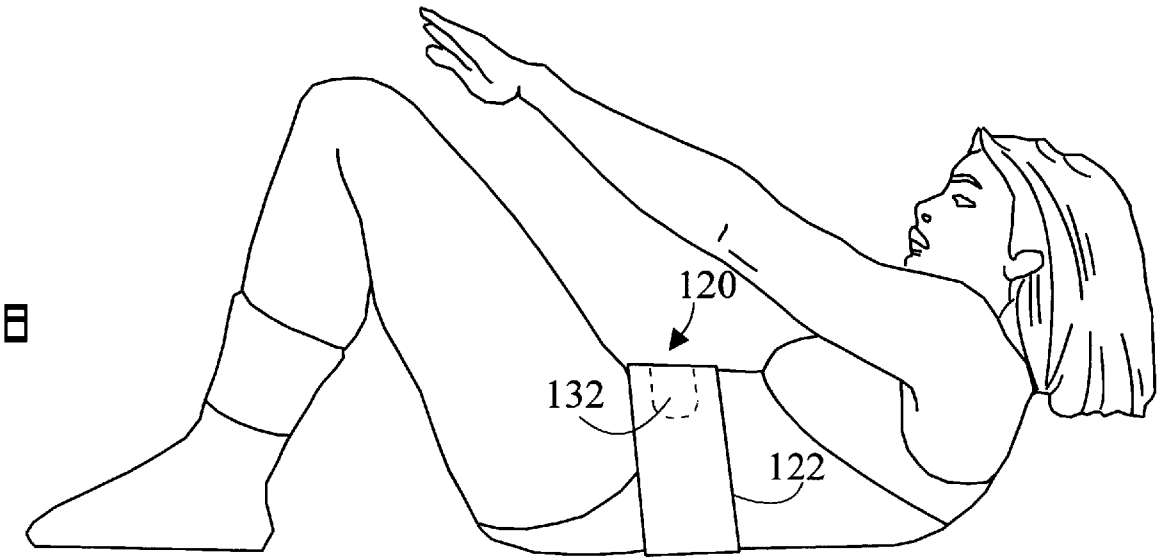

FIG. 8 is a side elevation view of a user wearing embodiment 120 of the present invention. When inflatable exercise belt 120 is placed around the waist of a user, inflatable air chamber 132 is disposed in a substantial horizontal orientation over the abdominal muscles of the user. Inflated air chamber 132 exerts pressure on the abdominal muscles.

In terms of use, a method of exercising, comprises:

providing an inflatable exercise belt, including a substantially belt-shaped body having a first end portion and an opposite second end portion, an inflatable air chamber disposed at said first end portion, a bulb-type pump communicating with the inflatable air chamber for selectively inflating same, and backing disposed adjacent to the inflatable air chamber, so that when the inflatable air chamber is inflated the inflatable air chamber expands in a direction away from the firm backing and toward the user;

a user placing and securing the exercise belt around his/her abdomen so that the inflatable air chamber is adjacent to the user's abdomen and is disposed between the user and the backing;

using the bulb-type pump to inflate the inflatable air chamber; and, the user exercising in a desired manner.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method of placing an exercise belt on the abdomen of a user, comprising the steps of:

(a) providing said exercise belt which includes:

a substantially belt-shaped body having a first end portion and an opposite second end portion;

said belt-shaped body having an inside which is placed against the body of the user and an opposite outside;

said belt-shaped body having only one inflatable air chamber, said inflatable air chamber disposed at said first end portion; and, firm backing disposed adjacent to said inflatable air chamber, so that when said inflatable air chamber is placed adjacent to the abdomen of the user and inflated said inflatable air chamber expands in a direction away from said backing and toward said inside, thereby exerting pressure on the abdomen of the user;

said exercise belt including a bulb pump;

said body including neoprene;

(b) placing said inflatable air chamber adjacent to the user's abdomen so that when inflated said inflatable air chamber will place isometric pressure against the abdominal muscles of the user;

(c) connecting said first end portion to said second end portion, wherein the location of said inflatable air chamber at said first end portion makes it possible for the user to make said connection at the abdomen of the user, thereby avoiding the need in a conventional exercise belt having a centrally disposed air chamber to (1) place the inflatable chamber of the conventional exercise belt adjacent to the user's abdomen and connect the end portions behind the user's back, and (2) connect the end portions of the conventional exercise belt at the user's abdomen, and then rotate the conventional exercise belt 180° so that the air chamber is adjacent to the user's abdomen;

(d) using said bulb pump to inflate said inflatable air chamber; and, (e) performing a desired exercise.

* * * * *